United States Patent [19]

Noda

[11] Patent Number: 4,856,415

[45] Date of Patent: Aug. 15, 1989

[54] RODLESS CYLINDER ASSEMBLY

[75] Inventor: Mitsuo Noda, Ichinomiya, Japan

[73] Assignee: Howa Machinery, Ltd., Nagoya, Japan

[21] Appl. No.: 146,047

[22] Filed: Jan. 20, 1988

[30] Foreign Application Priority Data

Jan. 30, 1987 [JP] Japan ..... 62-21102

[51] Int. Cl.[4] ..... F01B 29/00

[52] U.S. Cl. ..... 92/88; 92/13; 92/85 R; 384/42

[58] Field of Search ..... 92/13, 13.7, 85 R, 88, 92/137; 244/63; 384/40, 42; 248/279, 297.2, 316.1

[56] References Cited

U.S. PATENT DOCUMENTS

| | | | |
|---|---|---|---|
| 3,421,718 | 1/1967 | Gehringer et al. | 244/63 |
| 3,454,242 | 7/1969 | Feder et al. | 92/88 |
| 4,519,297 | 5/1985 | Lipinski | 92/88 |
| 4,566,738 | 1/1986 | Fasth | 384/42 |
| 4,664,019 | 5/1987 | Lipinski et al. | 92/88 |
| 4,685,383 | 8/1987 | Ruchser | 92/88 |
| 4,724,744 | 2/1988 | Rosengren | 92/88 |

FOREIGN PATENT DOCUMENTS

| | | | |
|---|---|---|---|
| 0104364 | 8/1983 | European Pat. Off. | 92/88 |
| 5850302 | 3/1988 | Japan . | |
| 0728038 | 4/1955 | United Kingdom | 92/88 |

OTHER PUBLICATIONS

"Lintra Rodless Cylinders" Norgren Martonair 5/87.

*Primary Examiner*—Robert E. Garrett
*Assistant Examiner*—Thomas Denion
*Attorney, Agent, or Firm*—Ladas & Parry

[57] ABSTRACT

A rodless cylinder assembly comprises a cylinder barrel provided with an axial bore in which a piston is slidably fitted and a slit formed in the outer surface thereof so as to be directed upwardly. A slide mount is operatively connected to the piston through connecting member integrally formed with the piston and projecting outwardly through the slit to be slidable along the upper surface of the cylinder barrel in an axial direction in accordance with the movement of the piston. The slide mount is slid along first guide rails disposed on the upper surface of the cylinder barrel at both sides of the slit and along second guide rail formed in opposite side walls of the cylinder barrel. Guide members are disposed between the second guide rails and side depending walls portions of the slide mount and the clearance between the second guide rails and the guide members can be adjusted by screw means. Each of the second guide rails has a guide surface inclined inwardly towards a cross-sectionally central portion of the cylinder barrel.

The above construction makes it possible to cause the slide mount to move smoothly along the cylinder barrel irrespective of external forces acting on the assembly.

28 Claims, 4 Drawing Sheets

RODLESS CYLINDER ASSEMBLY

BACKGROUND OF THE INVENTION

This invention relates to a rodless cylinder assembly, and more particularly, to a rodless cylinder assembly in which a piston is fitted in a cylinder barrel provided with an axial slit on the outer surface thereof from which a connecting part of the piston projects outwardly, and a slide mount is coupled to the connecting part while the axial slit is sealed by means of a seal band.

Japanese Patent Application Laid-Open (KOKAI) No. Sho-58-50302 published in 1983 discloses a rodless cylinder assembly of the type described above, in which a cylinder barrel is provided at both, i.e. opposite side walls with guide grooves of substantially V-shaped cross section and guide ridges of substantially V-shaped cross section are provided on a slide mount to be axially movable along the guide grooves in engagement therewith.

With the rodless cylinder assembly of the character disclosed in the said prior art publication, when a large load is applied to an upper surface of the slide mount, there is a fear of the opposite side walls of the cylinder barrel being deformed inwardly because of forcible pressing of the guide ridges against the lower oblique inner wall surfaces of the guide grooves. Moreover, when a lateral bending moment is applied to the slide mount, both the side walls of the cylinder barrel are inwardly deformed due to forcible pressing of one guide ridge against the upper oblique inner wall surface of one guide groove and forcible pressing of the other guide ridge against the lower oblique inner wall surface of the other guide groove, so that the axial slit of the cylinder barrel is narrowed and smooth displacement of the piston within the cylinder barrel becomes difficult. It will be noted that this provides a significant problem for the construction of a rodless cylinder of conventional type.

SUMMARY OF THE INVENTION

An object of this invention is to eliminate the defects or drawbacks of the prior art technique as described above and to provide an improved rodless cylinder assembly capable of smoothly moving a slide mount in an axial direction on a cylinder barrel of the assembly without substantial deformation in a case where a vertical load is applied to the upper surface of the slide mount or a lateral bending moment is applied thereto.

According to this invention, this and other objects can be achieved by providing a rodless cylinder assembly wherein a slit is formed on the upper wall of a cylinder barrel so as to extend along the axial length thereof and communicate with the cylinder bore of the barrel, first guide means are disposed on both, i.e. opposite sides of the slit on the upper wall of the cylinder barrel with the guide surfaces thereof disposed approximately horizontally, second guide means are disposed on opposite side walls of the cylinder barrel, and slide guide members are provided for a slide mount which is slidable on and along the cylinder barrel to be guided along the first and second guide means.

According to the rodless cylinder assembly of the construction defined above, since the slide mount is provided with the slide members to be guided along the guide means disposed on the cylinder barrel, the slide mount can be linearly moved smoothly therealong in the axial direction of the barrel, thus elongating the life of a piston operatively connected to the slide mount. In addition, the guide means are disposed on the upper and side walls or surfaces of the cylinder barrel, respectively, and the upper guide means have guide surfaces disposed substantially horizontally when the slit is directed upwardly, whereby all or almost all of load, even when it is a large load, applied to the upper surface of the slide mount can be borne by both the upper guide means on the cylinder barrel as a force applied in a direction normal to the width direction of the slit. Moreover, in a case where a lateral bending moment acts on the slide mount, the bending moment can be borne by the guide means disposed on one side of the cylinder barrel as a force applied in the direction normal to the width direction of the slit, whereby the deformation of the side walls of the cylinder barrel in the slit width direction can be substantially reduced, which can also obviate the dimensional deformation of the slit in the width direction thereof.

In a preferred embodiment of this invention, the guide means at the opposite side walls of the cylinder barrel are formed so as to have guide surfaces inclined downwardly towards the cross-sectionally central portion, and the slide mount is disposed slidably on the upper guide means of the cylinder barrel. The slide mount is provided with a pair of depending walls extending downwardly from both sides of the central base of the slide mount so as to hold the cylinder barrel, and the depending walls are provided with semi-cylindrical guide grooves in which approximately semi-cylindrical guide rods are retained, respectively, in such a manner that the cut surfaces of the guide rods engage with the inclined surface of the guide means disposed on both sides of the cylinder barrel. The base of the slide mount is also provided with a cut-in slot such that one of the depending walls can be elastically deformed slightly inwards and the amount of deformation can be adjusted by adjusting small clamping bolts screwed in the slide mount from the side portion thereof.

According to this embodiment, the clearance between the cut planar surface of the guide rod and the inclined surface of the guide means of the cylinder barrel can be easily and precisely adjusted by adjusting the amount of clamping or loosening of the small clamping bolts. Moreover, since the slide mount can be slid along the guide means located on the upper surface of the cylinder barrel in guided engagement with the inclined guide means, exact and smooth movement of the slide mount can be attained even in a case where a large load is applied to the upper surface of the slide mount or a large lateral bending moment acts thereon.

In another preferred embodiment of this invention, each of the guide rods guided by the guide means disposed on the opposite sides of the cylinder barrel has a longitudinal, i.e., axial extent included within the region between piston packings disposed on the two end portions of the piston.

According to this embodiment, in a case where the piston is forcibly moved by pneumatic pressure applied to the interior of the cylinder barrel, the forcible pressing of the guide means against the guide rods of the slide mount can be prevented substantially even if the opposite side walls of the cylinder barrel are outwardly deformed, whereby smooth linear movement of the slide mount along the cylinder barrel is achieved. Moreover, the guide rods can be accommodated within the region between the piston packings, thus being simply constructed with low manufacturing cost.

In a further preferred embodiment of this invention, the guide means disposed on both side walls of the cylinder barrel are defined by parts of inner surfaces of the axial guide grooves formed in the cylinder barrel, and fixing brackets are mounted on portions of the upper surface of the cylinder barrel near the opposite longitudinal ends. The attachment of the brackets is performed by clamping fixing members fitted in the guide grooves beneath the brackets, and stoppers are secured to the brackets.

According to this embodiment, the cylinder barrel is provided at both side- walls with a pair of the guide grooves parallel to the axial direction thereof which receive therein the guide rods of the slide mount to ensure smooth linear movement of the slide mount, which enables elongation of the life of use of the piston. Since the fixing brackets are secured to the cylinder barrel to be positionally adjustable and stoppers are attached to the brackets, respectively, the movement of the slide mount along the cylinder barrel is limited by means of the stoppers so as to stop the slide mount at any desired position, and accordingly, the slide mount can be moved with various desired strokes. In addition, the respective stoppers are secured to the corresponding brackets in the clamped manner by utilizing the guide grooves formed on the opposite side walls of the cylinder barrel for guiding the slide mount, so that there is no need of any mounting grooves on the upper wall of the cylinder barrel for attaching the stoppers, whereby the strength of the upper wall of the cylinder barrel is not reduced. Furthermore, the attachment of the fixing brackets is performed by clamping the clamping members fitted into the guide grooves to the lower surfaces of the brackets mounted on the upper surface of the cylinder barrel, whereby the attachment of the fixing brackets is carried out without substantially deforming the side walls of the cylinder barrel.

This invention will be described further in detail hereinbelow with reference to the accompanying drawings.

DESCRIPTION OF THE PREFERRED EMBODIMENT

Figure 1:
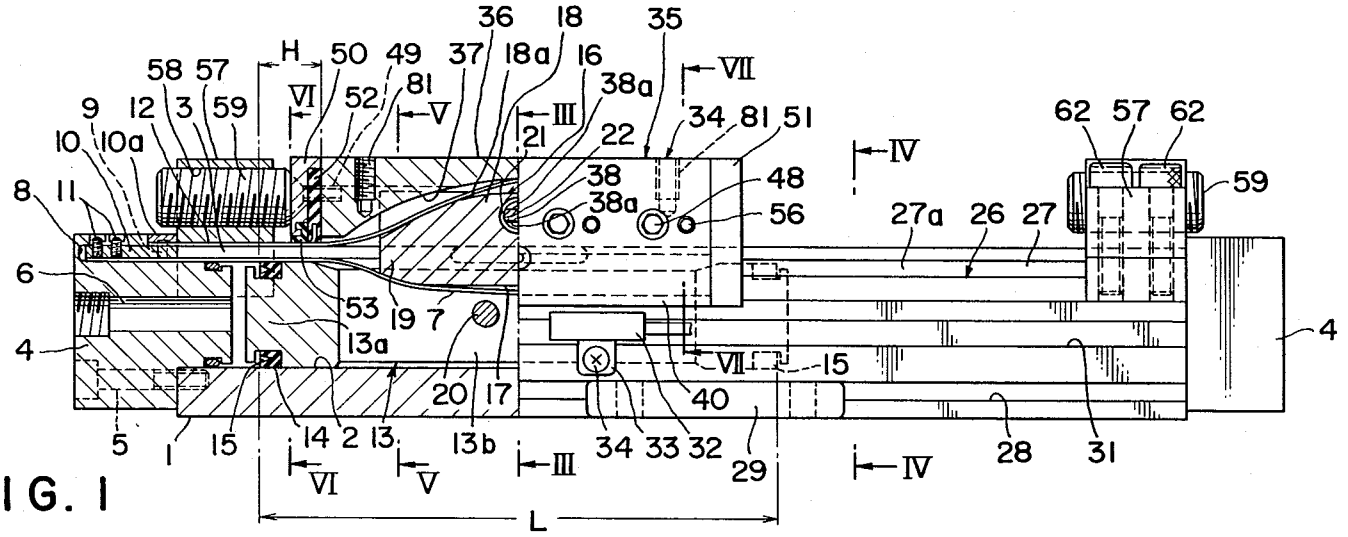
FIG. 1 is a side view, partly in section, of a rodless cylinder assembly according to this invention.

Referring to FIG. 1, a cylinder barrel 1 made of a non-magnetic material such as aluminum has an approximately rectangular cross section and is provided with an axial cylinder bore 2, in which a piston 13 is slidably inserted, and an axial slit 3 formed on the upper wall of the barrel 1. The slit 3 extends along substantially the entire axial length of the cylinder barrel 1. The opposite axial end portions of the cylinder barrel 1 are closed by end caps 4 which are secured thereto by bolts 5 and provided with through holes 6 for supplying or discharging compressed air into or out of the cylinder barrel 1, respectively. An inner seal band 7, made of a magnetic material with a width larger than the width of the slit 3, is disposed for closing the slit 3, and the opposite end portions of the seal band 7 are inserted respectively into insertion holes 8 formed in the end caps 4 and fastened thereto by screws 11 screwed in fixing plates 10 secured by fastening screws 9. An outer seal band 12, also made of a magnetic material with a width larger than the width of the slit 3, has both ends which are fastened to the end caps 4 through pressing plates 10*a* by the fastening screws 9 securing the fixing plates 10.

Figure 3:
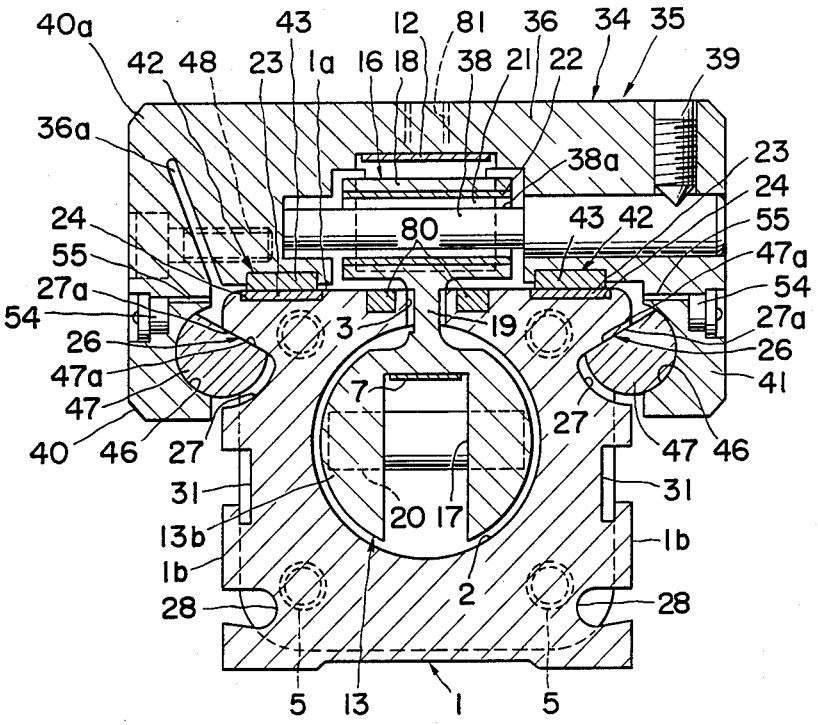
FIGS. 3 through 7 are cross sectional views of the rodless cylinder assembly taken along the lines III—III, IV—IV, V—V, VI—VI, and VII—VII, respectively, shown in FIG. 1.

As shown in FIG. 3, magnetic bars 80 made of permanent magnet are embedded in the upper surface 1*a* of the cylinder barrel 1 at both longitudinal sides of the slit 3 so as to magnetically attract the two edge portions of the seal bands 7 and 12, respectively.

The piston 13 which is inserted into and movable along the cylinder bore 2 of the barrel 1 is provided near the axial ends 13*a* thereof with annular grooves 14 into which piston packings 15 made of an elastic material are fitted, respectively. These piston packings 15 are disposed with an appropriate interval L in the axial direction of the piston 13. The piston 13 has an intermediate portion 13b having an inverted U-shaped cross section as shown in FIG. 3 so as to define a box-shaped groove 17 which opens downwardly, and the inner seal band 7 is passed through the groove 17.

Figure 5:
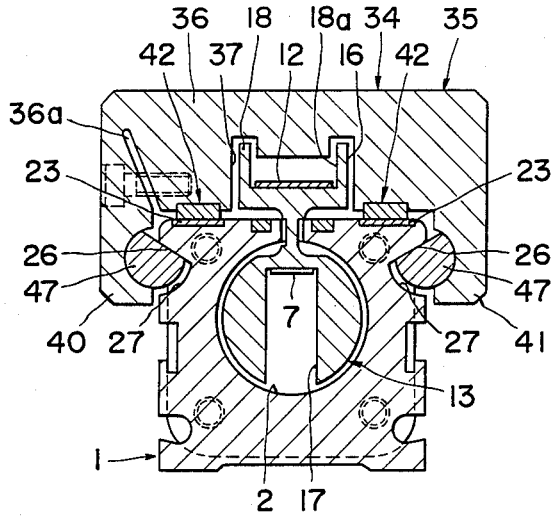

A connecting part 16 is formed integrally with the upper wall of the intermediate portion 13*b* of the piston 13. The connecting part 16 comprises an outer portion 18 located outside of the cylinder barrel 1 and a neck portion 19 extending through the slit 3. The outer portion 18 is provided with a connecting hole 21 extending in a direction normal to the moving direction of the piston 13 and disposed at a position intermediate between the two piston packings 15. A bush 22 is fitted in the connecting hole 21. A box-shaped groove 18*a* is formed in the upper surface of the outer portion 18 of the connecting part 16, and the outer seal band 12 is passed through the groove 18*a* as shown in FIG. 5. At the intermediate portion 13*b* of the piston 13 are embedded axially spaced two magnet rods 20, (only one is shown in FIG. 1) which constitute members to be detected for actuating a position detecting switch, described hereinafter.

Guide rails 23 are located on the upper surface 1*a* of the cylinder barrel 1 at both sides of the slit 3 and extend along the entire length thereof. The guide rails 23 are constituted by wear-proof bands made of stainless steel, for example, bonded to the surfaces of grooves 24 formed in the upper surface la of the cylinder barrel 1. As best shown in FIG. 3, the guide rails 23 are positioned over and along the thicknesses of the side walls of the cylinder barrel 1, respectively, so that the guide rails 23 are in parallel with the slit 3 and lie in substantially the same plane as the upper surface 1*a* of the cylinder barrel 1. In a modification, the guide rails 23 may be eliminated by subjecting the upper surface 1*a* of the cylinder barrel 1 to hard alumite treatment.

Inclined guide surfaces 26 are formed at opposite side wall portions of the cylinder barrel 1 and at upper portions of the side surfaces 1*b* of the same so as to extend along the entire length thereof. The inclined guide surfaces 26 are defined by upper oblique surfaces 27*a* of guide grooves 27 of substantially V-shaped cross section formed in the side surfaces 1*b* of the cylinder barrel 1, respectively, the oblique surfaces 27*a* being inclined downwardly towards the central portion of the barrel 1 with an inclination, relative to the horizontal direction, of about 30° . The inclined guide surfaces 26 may be replaced with linear rolling guides attached to the side surfaces 1*b* of the barrel 1, and the inclination may be also selected appropriately.

Figure 4:
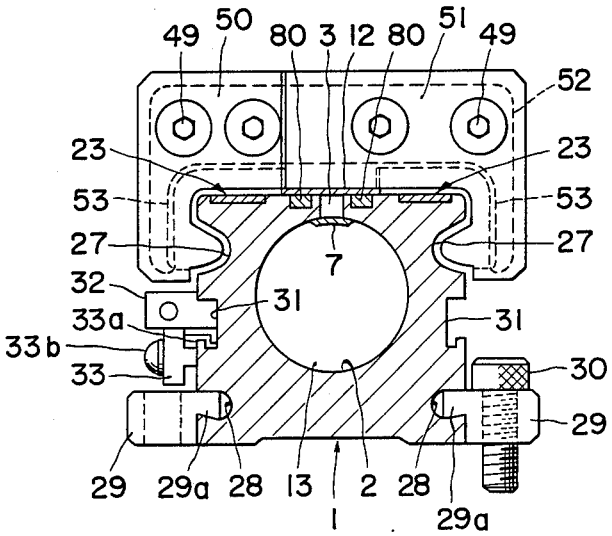

Fixing grooves 28 are formed at both sides of the slit 3 and at the lower portions of the side surfaces 1*b* of the cylinder barrel 1 so as to extend along the entire length thereof. As shown in FIG. 4, the fixing grooves 28 are engaged at optional positions with engaging portions 29*a* of support members 29, respectively, so that the cylinder barrel 1 is attached to a base (not shown) to which the support members 29 are secured by fixing bolts 30.

At intermediate portions of the side surfaces 1*b* of the cylinder barrel 1 are formed engaging grooves 31, respectively, so as to extend along the entire axial length thereof. Each groove 31 is used to engage and mount a portion 33*a* of a fixing member 33 for a position detecting switch 32, which can be secured to the cylinder barrel 1 by a clamping and fixing screw 33*b*.

A slide mount 34 is mounted on the connecting part 16 to be connectable to the outer portion 18 thereof, and the body 35 of the slide mount 34 comprises a central base 36 and a pair of depending walls 40 and 41 extending downwardly from both edges of the base 36 so as to partly cover the opposite side walls of the cylinder barrel 1, thus exhibiting a substantially inverted U-shaped cross section. The base 36 is provided with a threaded hole 81 (FIG. 3) in the upper surface thereof for fixing a body to be shifted and with a groove 37 (FIG. 5) in the lower surface thereof in which the outer portion 18 of the connecting part 16 is fitted loosely. A connecting pin 38 is secured by a screw 39 to the base 36 of the slide mount 34 at a longitudinally central portion thereof so as to extend across the groove 37, and the connecting pin 38 is inserted with a slight annular gap through the bush 22. The connecting pin 38 is provided with cutouts 38*a* at the upper and lower sides thereof so as to form vertical gaps in a direction normal to the moving direction of the piston between the connecting pin 38 and the bush 22, the vertical gaps being greater than the gaps in the moving direction of the piston 13.

Sliding members 42 slidable along the respective guide rails 23 are bonded to the lower surface of the base 36 of the slide mount 34. The sliding member 42 may comprise a strip of a metal such as oil containing sintered metal in a case where the body 35 of the slide mount 34 is made of aluminum. This is adapted for use in the case of relatively low speed movement of the slide mount 34 and relatively high load imposed thereon. Alternatively, when the slide mount body 35 is made of a steel material having a portion, corresponding to the position of the sliding member 42, hardened for example by means of quenching, or the body 35 is made of aluminum having a portion, corresponding to the position of the sliding member 42, to which a wear-proof strip such as a stainless steel strip is bonded, the sliding member 42 may be constituted by pin rolls of an alloy steel or alloy rolls provided with a flat roll retainer. Furthermore, when the guide rails 23 are constituted by the upper surface of the cylinder barrel 1 itself, the sliding member 42 may be constituted by sheets of plastics such as polyacetal resin or sheets each formed by a steel plate to which copper alloy and polyacetal resin are applied. This constitution is advantageously applicable in a case where the slide mount is moved at a relatively high speed under relatively low load.

A pair of semi-cylindrical grooves 46 are formed in the inside surfaces of the respective depending walls 40 and 41 of the slide mount 34 so as to extend along the entire length thereof, and elongated columnar guide rods 47, each having a cutout planar surface 47*a* to show a substantially semi-circular cross section and made of a plastic material such as polyacetal resin, are fitted in the corresponding cylindrical grooves 46 in such a manner that the cylindrical outer surfaces of the guide rods 46 are engaged with the cylindrical inner surfaces of the grooves 46. The guide rods 47 are disposed in a sealed manner between retainer plates 50 and 51 (FIG. 1) secured to the opposite end surfaces of the slide mount body 35 by fixing bolts 49. Accordingly, the guide rods 47 can be retained within the grooves 46 to be rotatable therein without being axially disengaged therefrom.

Figure 7:
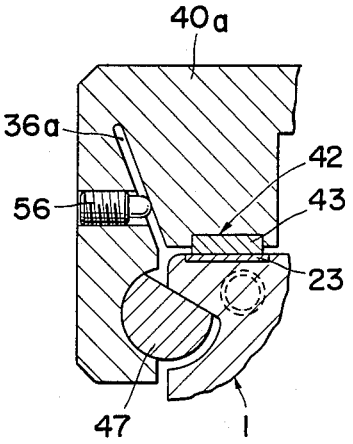

As shown in FIG. 3, a cut-in slot 36*a* is formed in one side portion (left side in FIG. 3) of the base 36 so as to extend along the entire length thereof so that the depending wall 40 can be slightly inwardly deformed elastically with the thin portion 40*a* functioning as a fulcrum. The amount of deformation is adjusted by a plurality of clamping bolts 48 screwed into the base 36 of the slide mount body 35 at its portion inward of the cut-in slot 36*a* and by a plurality of loosening screws 56 (FIG. 7) with the tip ends thereof abutting against the inner surface of the cut-in slot 36*a*. The clearance between the planar guide surface 47*a* of the semi-cylindrical guide rod 47 at the left side of FIG. 3 and the inclined guide surface 26 at the same side can thus be adjusted to be about 0.05–0.10 mm by adjusting the amounts of screwing of the clamping screws 48 and the loosening screws 56 which are arranged with suitable spacings, respectively, along the entire length of the slide mount body 35.

The longitudinal dimension of the slide mount body 35, i.e., the length of the guide rod 47, is preset to be a length smaller than the distance L between the piston packings 15 disposed at both ends thereof by the predetermined distances H (FIG. 1) longitudinally inwardly from the piston packings 15. For the purpose of reducing the influences by the deformation of the cylinder barrel 1 during the operation, it is desirable that the distance H is equal to or more than a half of the bore diameter of the cylinder barrel 1 and at least about 10 mm or more. For example, in case of the cylinder bore diameter being of 25 mm, it is desirable that the distance H is about 15 mm and in case of the cylinder bore diameter being 40 mm, it is desirable that the distance H is about 20 mm.

As shown in FIG. 1, seal members 52 are disposed at both end portions of the slide mount body 35 in a condition clamped between the body 35 and the retainer plates 50 and 51, each of the seal members 52 having the lower central portion thereof slidably contacting the upper surface of the seal band 12. The seal plates 52 may be made of a plastic material such as polyacetal resin.

Approximately inverted U-shaped scrapers 53 are parallelly disposed outside of the seal plates 52 in a state clamped through the seal plates 52 between the slide mount body 35 and the retainer plates 50 and 51, each of the scrapers 53 being made of an elastic material such as rubber and having the lower portion thereof slidably contacting the upper surface of the cylinder barrel 1 and the inner surface of the guide grooves 27, respectively. Into the gaps defined by the upper surface of the cylinder barrel 1 and the lower surface of the slide mount 34 is supplied a lubricating oil through grease nipples 54 disposed at outside portions of the depending walls 40 and 41 and through lubricating oil passages 55.

Figure 2:
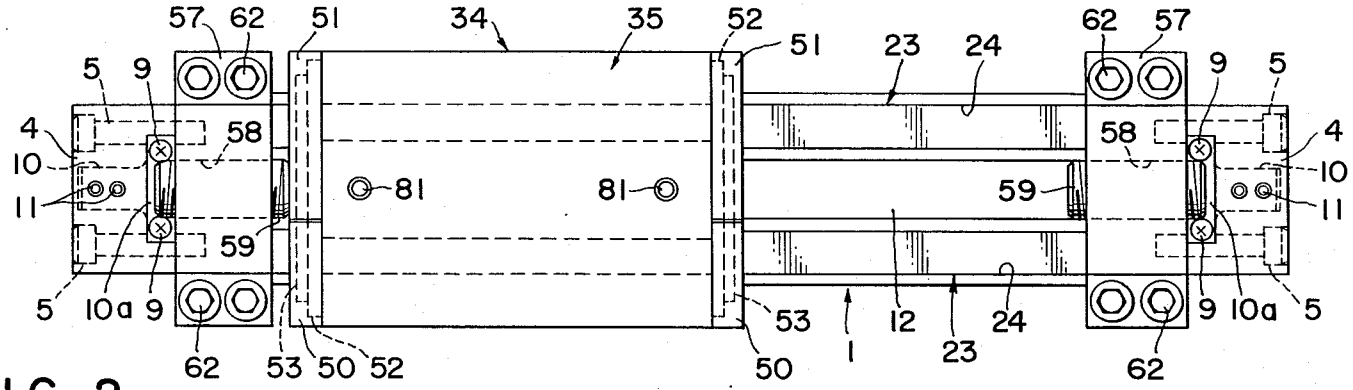
FIG. 2 is a plan view of the rodless cylinder assembly shown in FIG. 1.
Figure 6:
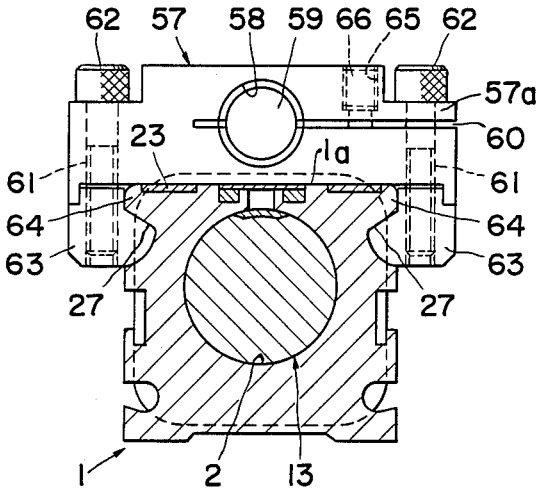

As shown in FIGS. 1 and 2, in order to regulate the displacement of the slide mount 34, there are disposed stoppers 59 (FIG. 1) in the form of a screwed pin which are supported by fixing brackets 57 secured to the opposite end portions of the cylinder barrel 1. Each of the brackets 57 is provided with an axial threaded bore 58 for engaging and fixing the stopper 59 and a cut-in slot 60 (FIG. 6) formed from the one side of the bracket 57 so that the upper wall portion 57*a* of the bracket 57 can be slightly deformed up and down. The bracket 57 is secured to the cylinder barrel 1 by screwing the stopper 59 into the threaded bore 58, inserting a plurality, four in the embodiment shown, of fixing bolts 62 through vertical holes 61, and screw-engaging the bolts 62 into threaded holes formed in clamping members 63 mounted in the guide grooves 27 of the cylinder barrel 1, respectively, and, as a result, the bracket 57 is fixed with ledges 64 of the cylinder barrel 1 being interposed between the bracket 57 and the clamping members 63, while the stoppers 59 are also locked. Small machine screws 65 are screwed in the upper wall 57*a* from the upper side thereof with the tip ends thereof abutting against the cut surface of the cut-in slot 60, and the stoppers 59 are released from their locked state by loosening the screws 65 to thereby allow the wall 57*a* to deform upwardly. According to these constructions, the stoppers 59 can be secured to optional portions of the cylinder barrel 1, thus being capable of freely adjusting the stroke of the slide mount 34. The stoppers 59 may be constructed in the form of a shock absorber of pin form.

Figure 8:
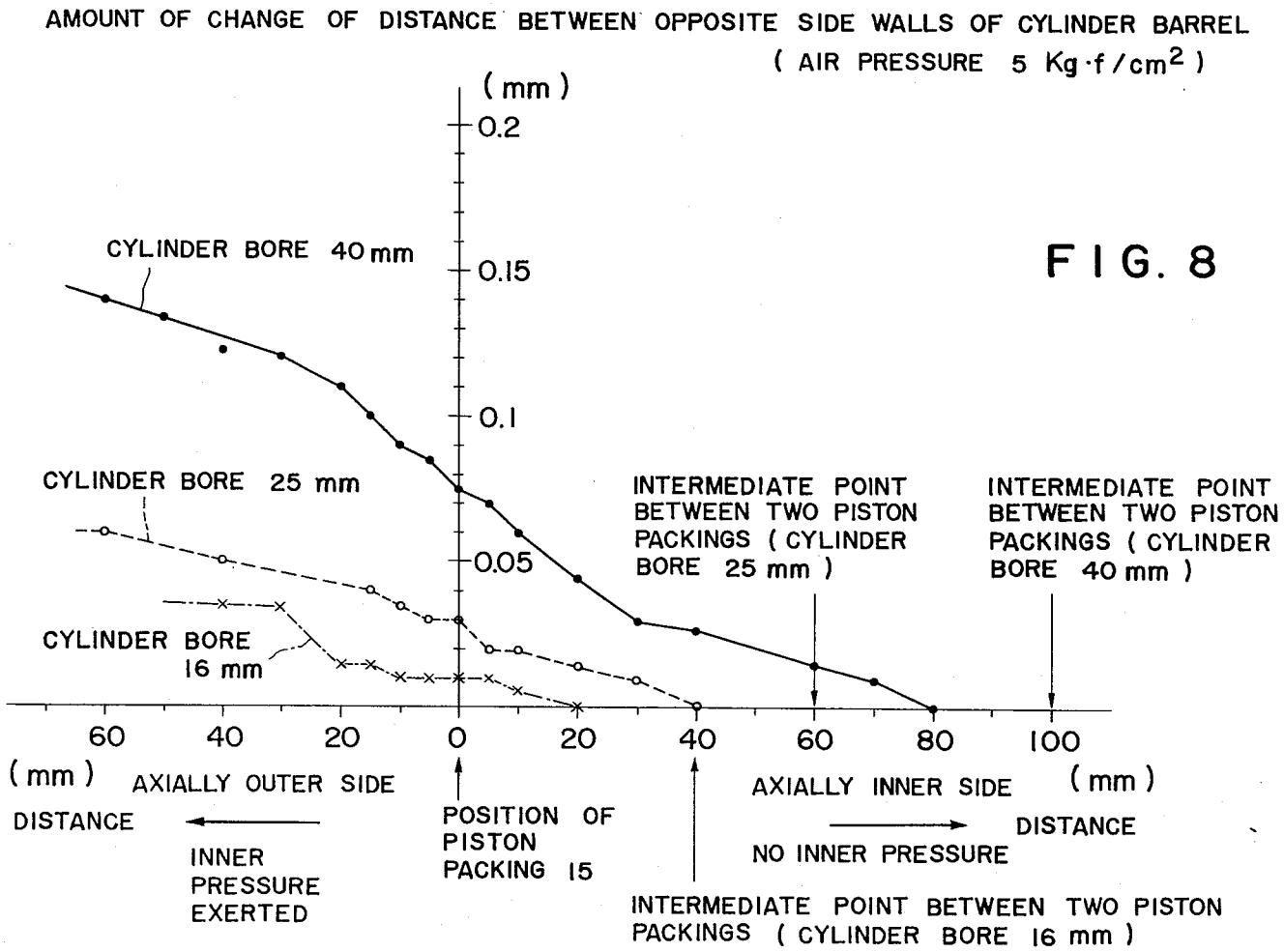
FIG. 8 is a graph representing relationships between the position of a piston packing and the amount of change of the distance between the opposite side walls of a cylinder barrel.

With the embodiment having constructions shown and described hereinbefore, compressed air introduced into a cylinder chamber of the cylinder barrel 1 through one air supplying or discharging hole 6 acts on the end face of the piston 13 to move the same, whereby the slide mount 34 is also moved in accordance with the movement of the piston through the engagement of the connecting part 16 and the coupling pin 38. During the movement, the slide mount 34 can be smoothly and stably displaced in the axial direction because both the sliding members 42 slide on and along the guide rails 23 of the cylinder barrel 1 and both the guide rods 47 also slide on and along the inclined guide surfaces 26 of the cylinder barrel 1. At this time, the pneumatic pressure of the compressed air supplied in the cylinder chamber acts on the inner surface of the cylinder bore 2 thereby to outwardly deform the opposite side wall portions of the barrel 1 in the region near the slit 3. As shown in FIG. 8, the amount of deformation of the wall portions increases towards the axially outward direction away from the position of the piston packings 15, whereas it sharply decreases towards the axially inward direction away from the piston packings 15. This s because internal pressure exists in the axially outward space adjoining the piston and part 13*a* but does not exist axially inside of the piston end part 13*a*.

As demonstrated in FIG. 8, for example, at a pneumatic pressure of 5 kgf/cm$^2$ in the cylinder chamber of the cylinder barrel having the bore diameter of 25 mm, the amount of deformation between the outside surfaces of the side walls of the cylinder barrel 1 at the location of the piston packing 15 is 0.03 mm, 0.04 mm at a position apart outwardly from the location of the packing by 15 mm, 0.02 mm at a position apart inwardly from the location of the packing by 10 mm, and substantially 0 mm at a position apart inwardly from the location of the packing. In this connection, since the extents of the guide rods 47 on both the sides of the slide mount 34 are completely inside the locations of the two piston packings 15, that is, within the region of small or no deformation, the inclined guide surfaces 26 can be prevented from forcibly contacting the guide rods 47 even when the deformation of the side walls of the cylinder barrel 1 occurs. Particularly, when the inclined guide surfaces 26 are disposed at an inclination of 30°, the deformation thereof in the direction towards the clearance of the guide rod 47 is merely 0.01 mm even when the deformation in the direction of the slit width is 0.02 mm, whereby the surfaces 26 are prevented from forcibly contacting the corresponding guide rod 47.

When the slide mount 34 is moved in the fashion described above, the scrapers 53 slide on and sweep the upper surfaces of the seal band 12, the guide rails 23 and the cylinder barrel 1 and the inner surfaces of the guide grooves 27, respectively, and the seal plates 52 also slide at this time on the upper surface of the seal band 12 thereby to ensure the adhesion of the seal band 12 to the magnetic band 80.

The slide mount 34 moved to the terminal end abuts against one of the stoppers 59 and stops at the exact position, and when the piston 13 has been moved to a predetermined position, the magnet rod 20 acts on the position detecting switch 32 to detect the position of the piston 13.

In the state of use in which the cylinder barrel 1 is set with the slit 3 directed upwardly, when a large load is applied downwardly to the upper surface of the slide mount 34, the load is borne by the guide rails 23 of the cylinder barrel 1. Since the guide rails 23 have the upper surfaces parallel to the direction of width of the slit 3, the load is borne by the counterforce of the direction normal to the width direction of the slit 3, and accordingly, since stresses in the direction of the slit are not substantially produced, the inclined guide surfaces 26 are not caused to forcibly contact the guide rods 47, thus enabling smooth movement of the slide mount 34. In a case where large lateral bending moment is applied to the slide mount 34 from the righthand direction as viewed in FIG. 3, the guide rod 47 at the left side presses the inclined guide surface 26 and the sliding member 42 at the right side presses the guide rail 23. When the left side guide rod 47 presses the inclined guide surface 26. since the upper oblique surface 27*a* of the guide groove 27 is inclined by about 30° with respect to the slit width direction, the inclined guide surface 26 receives the pressing force of the guide rod 47, which force consists of an upwardly directed counterforce and a rightwardly directed counterforce smaller than the upwardly directed force, whereby the left side wall is deformed slightly inwardly. When the right side sliding member 42 presses the guide rail 23, the pressing force is received as a downwardly directed (i.e. normal to the slit width direction) force, and the right side wall receives substantially no stress in the slit width direction, thus being not deformed.

As described above, even in a case where a relatively large lateral bending moment is applied to the slide mount 34, the side walls of the cylinder barrel 1 are deformed only slightly in the width direction of the slit, and the inclined guide surfaces 26 can be effectively prevented from forcibly contacting the guide rods 47, respectively, thus ensuring smooth sliding movement of the slide mount. In addition, the clearance between the guide rod 47 and the inclined guide surface 26 can be easily adjusted by adjusting the clamping force of the clamping screw 48 screwed to one depending wall 40 with the guide rod 47 of the other depending wall 41 in abutment with the inclined guide surface 26. Moreover, the deformation of the slit 3 in the width direction thereof due to the clamping of the bolt 48 is converted into a displacement of an amount of half the deformation in the direction of the clearance between the guide rod 47 and the inclined guide surface 26 when the inclination thereof is 30°, whereby it is possible to control the clearance minutely. After adjusting the clearance to a desired amount, the clamping bolt 48 and the small bolt 56 are mutually locked by clamping the latter thereby to ensure and keep the desired clearance originally set for a long time of use of the slide mount.

What is claimed is:

1. A rodless cylinder assembly, comprising: a cylinder barrel provided with an axial bore and an outer wall in which a slit is formed so as to extend in an axial direction of the cylinder barrel, the cylinder barrel being arranged substantially horizontally with said slit being directed upwardly;

a piston member slidably fitted in said axial bore of the cylinder barrel;

connecting means formed integrally with said piston member so as to project outwardly through said slit;

sealing means for sealing said slit;

a slide mount operatively connected to said connecting means to be slidable along the outer wall surface of said cylinder barrel in accordance with the movement of said piston member in the axial bore of said cylinder barrel, said slide mount comprising a central base portion and a pair of depending wall portions extending downwardly from both longitudinal sides of said base portion so as to be located outwardly of, and close to opposite side walls of said cylinder barrel, said depending wall portions rotatably supporting guide rods having planar guide surfaces, said base portion of the slide mount being provided in one longitudinal side portion with a cut-in slot so that one of said depending wall portions is elastically deformable inwardly and the amount of deformation is adjustable by screw means screwed in said slide mount form one side thereof;

first guide means for said slide mount, said guide means having guide surfaces and disposed on an upper wall surface of said cylinder barrel on both sides of said slit with the guide surfaces lying substantially in a horizontal plane;

second guide means for said slide amount, disposed on the opposite side walls of said cylinder barrel, said second guide means being inclined guide surfaces disposed on the opposite side walls of said cylinder barrel and inclined downwardly towards a cross-sectionally central portion of the cylinder barrel, said inclined guide surfaces engaging said planar guide surfaces of the guide rods, respectively; and guide members provided for said slide mount so as to be guided along said first guide means.

2. The rodless cylinder assembly according to claim 1 wherein said first guide means are guide rails disposed horizontally on the upper surface of said cylinder barrel at positions substantially over the thicknesses of the opposite side walls of the cylinder barrel, respectively.

3. The rodless cylinder assembly according to claim 2 wherein said first guide means are constituted by wear-proof bands secured to the upper surfaces of said cylinder barrel.

4. The rodless cylinder assembly according to claim 2 wherein said first guide means are constituted by the upper surface itself of said cylinder barrel which is a hard alumite surface.

5. The rodless cylinder assembly according to claim 1 wherein each of said inclined guide surfaces has an inclination of about 30° relative to the horizontal.

6. The rodless cylinder assembly according to claim 1 wherein said depending wall portions of said slide mount are provided with semi-cylindrical guide grooves at portions facing said inclined guide surfaces on the opposite side walls of said cylinder barrel and said guide rods, each comprising a semi-cylindrical columnar member with a cutout planar surface, are rotatably held in said guide grooves, respectively, said guide rods being held in sealed manner between retainer plates attached to both longitudinal ends of said slide mount.

7. The rodless cylinder assembly according to claim 1 wherein said screw means for adjusting the amount of deformation of one of said depending wall portions comprise clamping bolts screwed in said base portion and loosening screws screwed in said depending wall portion.

8. A rodless cylinder assembly, comprising:

a cylinder barrel provided with an axial bore and an outer wall in which a slit is formed so as to extend in an axial direction of the cylinder barrel, the cylinder barrel being arranged substantially horizontally with said slit being directed upwardly;

a piston member slidably fitted in said axial bore of the cylinder barrel;

connecting means formed integrally with said piston member so as to project outwardly through said slit;

sealing means for sealing said slit;

a slide mount operatively connected to said connecting means to be slidable along the outer wall surface of said cylinder barrel in accordance with the movement of said piston member in the axial bore of said cylinder barrel;

first guide means for said slide mount, said guide means having guide surfaces and disposed on an upper wall surface of said cylinder barrel on both sides of said slit with the guide surfaces lying substantially in a horizontal plane;

second guide means for said slide mount, disposed on opposite side walls of said cylinder barrel; and guide members provided for said slide mount so as to be guided along said first and second guide means, respectively, said guide members guided along said second guide means having an axial extent included within the region determined by a distance between a pair of piston packings disposed at both ends of said piston member, said guide members having the opposite ends thereof located axially inwardly of the axial ends of said region by a predetermined distance of at least 10 mm.

9. The rodless cylinder assembly according to claim 8 wherein said predetermined distance is a length equal to or more than half of a diameter of the cylinder bore of the cylinder barrel.

10. A rodless cylinder assembly, comprising:

a cylinder barrel provided with an axial bore and an outer wall in which a slit is formed so as to extend in an axial direction of the cylinder barrel, the cylinder barrel being arranged substantially horizontally with said slit being directed upwardly;

a piston member slidably fitted in said axial bore of the cylinder barrel;

connecting means formed integrally with said piston member so as to project outwardly through said slit;

sealing means for sealing said slit;

a slide mount operatively connected to said connecting means to be slidable along the outer wall surface of said cylinder barrel in accordance with the movement of said piston member in the axial bore of said cylinder barrel;

first guide means for said slide mount, said guide means having guide surfaces and disposed on an upper wall surface of said cylinder barrel on both sides of said slit with the guide surfaces lying substantially in a horizontal plane;

second guide means for said slide mount, disposed on opposite side walls of said cylinder barrel, said second guide means being constituted by parts of inner wall surfaces of axial guide grooves formed in the opposite side walls of said cylinder barrel; and guide members provided for said slide mount so as to be guided along said first and second guide means, respectively, said cylinder barrel being provided with upper surface portions near the longitudinal ends thereof on which are mounted fixing brackets each having a lower surface to which clamping members fitted into said guide grooves are clamped for securing said each bracket to which is secured a stopper for limiting the stroke of the slide mount.

11. The rodless cylinder assembly according to claim 10 wherein said fixing bracket is provided with a threaded bore extending axially of the cylinder barrel and a cut-in slot cut from one side surface of the bracket towards and into said bore, said stopper being screw-engaged with said threaded bore, said bracket being further provided with through holes crossing said cut-in slot through which are inserted fixing bolts which serve to clamp said clamping members to said cylinder barrel, thereby to also secure said stopper to said fixing bracket.

12. The rodless cylinder assembly according to claim 11 wherein a loosening screw is screwed in at least one of upper and lower portions, with respect to the interposed cut-in slot, of said bracket in a manner capable of widening the width of said cut-in slot.

13. The rodless assembly according to claim 10 wherein said stopper is constituted as a shock absorber.

14. A rodless assembly comprising:

a cylinder barrel disposed substantially horizontally and provided with an axial bore therein, said barrel having opposite walls and an upper wall in which a slit is formed so as to extend in an axial direction of the cylinder barrel, the cylinder barrel being arranged with said slit being directed upwardly;

a piston member slidably fitted in said axial bore of the cylinder barrel;

connecting means formed integrally with said piston member so as to project outwardly through said slit;

sealing means for sealing said slit;

a slide mount operatively connected to said connecting means to be slidable along the outer wall surface of said cylinder barrel in accordance with the movement of said piston member in the axial bore of said cylinder barrel, said slide mount being shaped to encompass said side walls and upper wall of said cylinder barrel;

a pair of first guide rails for said slide mount, said guide rails having guide surfaces and disposed on said upper wall of the cylinder barrel on both sides of said slit with the guide surfaces lying substantially in a horizontal plane;

a pair of second guide rails for said slide mount, disposed on said opposite side walls of the cylinder barrel, said second guide rails being formed by inclined guide surfaces extending downwardly towards a cross-sectionally central portion of the cylinder barrel and located at a lower level than said first guide rails, a pair of first guide means provided on an under surface of said slide mount so as to be guided by said first guide rails, respectively; and a pair of second guide means provided on inner surfaces of the parts of the slide mount, adjoining said side walls of the cylinder barrel, respectively, so as to be guided by said second guide rails.

15. The rodless cylinder assembly according to claim 14 wherein said first guide rails are disposed substantially over the thicknesses of said side walls of the cylinder barrel, respectively.

16. The rodless assembly according to claim 14 wherein said first guide rails are wear-proof bands.

17. The rodless cylinder assembly according to claim 14 wherein said first guide rails are hardened surface portions of said upper wall at the opposite sides of said slit.

18. The rodless cylinder assembly according to claim 14 wherein said slide mount comprises a central base portion and a pair of depending wall portions extending downwardly from both longitudinal sides of said base portion so as to e located outwardly of, and close to said opposite side walls of the cylinder barrel, said depending wall portions rotatably supporting guide rods having planar guide surfaces which slidably engage said inclined guide surfaces, respectively.

19. The rodless assembly according to claim 18 wherein said base portion of the slide mount is provided in one longitudinal side portion with a cut-in slot so that one of said depending wall portions is elastically deformable inwardly and the amount of deformation is adjustable by screw means screwed in said slide mount from one side thereof.

20. The rodless cylinder assembly according to claim 14 wherein each of said guide inclined guide surfaces has an inclination of about 30° relative to the horizontal.

21. The rodless assembly according to claim 18 wherein said depending wall portions of the slide mount are provided with semi-cylindrical guide grooves at portions facing said inclined guide surfaces on the opposite side walls of the cylinder barrel, and wherein each of said guide rods is a semi-cylindrical columnar member with a cutout planar surface and is rotatably held in one of said guide grooves, said guide rods being held in sealed manner between retainer plates attached to both longitudinal ends of the slide mount.

22. The rodless assembly according to claim 19 wherein said screw means for adjusting the amount of deformation of one of said depending wall portions comprise clamping bolts screwed in said base portion and loosening screws screwed in said depending wall portion.

23. The rodless cylinder assembly according to claim 14 wherein said second guide means have an axial extent included within the region determined by a distance between a pair of piston packings disposed at both ends of said piston member, said second guide means having the opposite ends thereof located axially inwardly of the axial ends of said region by a predetermined distance.

24. The rodless cylinder assembly according to claim 23 wherein said predetermined distance is a length equal to or more than half of a diameter of the cylinder bore of the cylinder barrel.

25. The rodless cylinder assembly according to claim 23 wherein said predetermined distance is at least 10 mm.

26. A rodless cylinder assembly comprising:

a cylinder barrel provided with an axial bore and an outer wall in which a slit is formed so as to extend in an axial direction of the cylinder barrel, the cylinder barrel being arranged substantially horizontally with said slit being directed upwardly;

a piston member being slidably fitted in said axial bore of the cylinder barrel and having a pair of piston packings provided at two ends thereof;

connecting means formed integrally with said piston member so as to project outwardly through said slit;

sealing means for sealing said slit;

a slide mount operatively connected to said connecting means to be slidable along the outer wall surface of said cylinder barrel in accordance with the movement of said piston member in the axial bore of said cylinder barrel;

first guide means for said slide mount, said guide means having guide surfaces and disposed on an upper wall surface of said cylinder barrel on both sides of said slit with the guide surfaces lying substantially in a horizontal plane;

second guide means for said slide mount, disposed on opposite side walls of said cylinder barrel; and guide members provided on said slide mount so as to be guided along said first and second guide means, respectively, said guide members guided along said second guide means having an axial extent included within the region determined by the distance between said piston packings, said guide members having the opposite ends thereof located axially inwardly of the axial ends of said region by a predetermined distance.

27. The rodless cylinder assembly according to claim 26 wherein said predetermined distance is a length equal to or more than half of a diameter of the cylinder bore of the cylinder barrel.

28. The rodless cylinder assembly according to claim 26 wherein said predetermined distance is at least 10 mm.

* * * * *